US007370439B1

(12) United States Patent
Myers

(10) Patent No.: US 7,370,439 B1
(45) Date of Patent: May 13, 2008

(54) FIELD AND STREAM BOOT

(76) Inventor: Robert J. Myers, 2701 E. Hammer La., #10, Stockton, CA (US) 95210

( * ) Notice: Subject to any disclaimer, the term of this patent is extended or adjusted under 35 U.S.C. 154(b) by 519 days.

(21) Appl. No.: 10/894,066

(22) Filed: Jul. 19, 2004

(51) Int. Cl.
*A43B 13/22* (2006.01)
*A43B 13/14* (2006.01)

(52) U.S. Cl. ..... 36/31; 36/30 R; 36/28; 36/30 A; 36/134

(58) Field of Classification Search ..... 36/30 R, 36/67 A, 67 D, 134, 61, 7.7, 7.6, 59 R
See application file for complete search history.

(56) References Cited

U.S. PATENT DOCUMENTS 830,324 A * 9/1906 Hunt ..... 36/61
3,538,628 A * 11/1970 Einstein, Jr. ..... 36/15
4,747,220 A * 5/1988 Autry et al. ..... 36/59 R
4,782,604 A * 11/1988 Wen-Shown ..... 36/127
5,775,005 A * 7/1998 McClelland ..... 36/31
5,946,828 A * 9/1999 Jordan et al. ..... 36/61
6,698,110 B1 * 3/2004 Robbins ..... 36/61

* cited by examiner

*Primary Examiner*—Jila M Mohandesi
(74) *Attorney, Agent, or Firm*—Milburn & Peterson, P.C.; Robert C. Peterson

(57) ABSTRACT

A field and stream boot for traversing rivers, lakes and stream beds, as well as, outdoor trails which includes; an upper construction with a hard heel, a hard toe, an ankle cup, and a metatarsus rigid panel that provide foot protection from outdoor or underwater terrain and obstacles; and an outsole construction where the outsole has peripheral intermittent tread surrounding a heel array of tungsten carbide spikes overlain with felt with the spike protruding through the felt but not below the peripheral intermittent tread, and surrounding a forefoot array of tungsten carbide spikes overlain with felt with the spikes protruding through the felt but not below the peripheral intermittent tread. The tread may be in the form of lugs, cleats or other gripping ribs or ridges.

16 Claims, 3 Drawing Sheets

FIELD AND STREAM BOOT

BACKGROUND OF THE INVENTION

1. Field

This invention relates to a field and stream wading boot and more particularly to a sole construction of the boot for walking and wading over underwater rocks and moss or algae, climbing in and out of a watercraft, and walking out of the water.

2. State of the Art

The construction and materials used in boots or shoes for various sports are such as to provide adequate traction between the boots or shoes and the surface or terrain on which they are used.

Common cleats of various descriptions which may or may not be removable from the sole of the boot or shoe are used on football shoes, baseball shoes, soccer shoes, etc. Climbing boots with spikes and hobnail shoes are usually for the type of terrain being encountered by persons in outdoor and indoor activities.

In the sole construction of a shoe or boot disclosed in U.S. Pat. No. 6,675,504B granted to Biancucci et. al., the sole has cleats that may be extended or retracted to project beyond the bottom of the sole or retracted into grooves or recesses formed in the sole. In this arrangement the wearers may choose to use spiked or unspiked soles.

Other wading boot designs include interchangeable rubber lugs, felt pads, or steel spiked soles. Thus, it is necessary to change the soles of the boots depending upon what conditions exist in the bed of the stream, river or lake where a fisher person would be wading. This arrangement creates a problem where the underwater bed contain rocks, moss and other underwater growth in various areas making it desirable to change the soles several times while wading in a particular underwater bed. Further, after wading in the water the wearers may want to climb into their watercraft but first must change soles to prevent damage to the watercraft. Likewise it would be unwise to walk on the shoreline with felt or rubber lug soles.

SUMMARY OF THE INVENTION

It is an object of the present invention to provide a versatile boot, especially for wading in the beds of streams, rivers, and lakes in which underwater rock, moss and other growths that present slippery footing may be overcome by the tread design, construction material and arrangement of the outsole of the boot. The construction makes use of metal spikes, felt pads or gripping pads and rubber cleats in such a manner as to provide stable footing and preclude the spikes from damaging watercrafts subject to punctures, etc.

It is another object of the invention to construct wading boots with an outsole combination of rubber cleats, felt pads and steel or tungsten carbide spikes which are highly wear resistant to permit extensive use of the boots before replacement.

It is a further feature of the invention to provide a wading boot with a composite sole having gripping spikes protruding through central felt pads where the ball and heel of the wearer's foot would rest surrounded by intermittent tread extending below the spikes of rubber or plastic along with a fluted or wavy rear slanted toe grip and a fluted or wavy forward slanted heel grip for wading stability.

An even further object of the invention is to provide a wading boot with an outsole having central felt pads where the ball and heel of the wearer's foot would rest with metal spikes within the felt pads extended slightly beyond the bottom of the felt pads. The outsole includes rubber or plastic lugs which extend below the metal spikes such that the wearer may walk on generally flat surfaces such as the deck or bottom of a watercraft without the spikes damaging the surfaces.

Further it is still another object of the invention to provide a field and boot with the upper including a duraforce hard heel, a hard or rigid cup or dome ankle guard, a duraforce hard toe and an inset toe joint guard, and an outsole having intermittent tread which may be rubber or plastic lugs along the periphery of the outsole which extend below the metal spikes such that the wearer may walk on generally flat surfaces such as the deck or bottom of a watercraft or docks or walkways without the spikes damaging the surfaces. The construction also provides the user with a boot that may be worn to hike from a parking area over trails through woods to a lake, river or stream. This outsole construction with tungsten carbide spikes provides long lasting use with minimum wear of the spikes and felt pads.

It is another further object of the invention to provide a wading boot especially for wear while traversing stream beds, rivers and lakes which pose obstacles such as mud, moss, rocks and other under water growths that present slippery footing. The boot is further designed to prevent damage to wood floors, aluminum bottom boats, fabric or plastic watercrafts, or other surfaces subject to damage by metal spikes. The construction provides outsoles of rubber or plastic formed with peripheral lugs or cleats, and central forefoot and heel members bearing metal spikes. Felt pads are positioned over the metal spikes and attached to the central forefoot and heel members with the metal spikes extending just below the felt pads but above the rubber or plastic lugs.

It is still another object of the invention to provide a wading boot with a sole construction including peripheral lugs or cleats as the outer most bottom tread or sole surface. The outsole has central forefoot and heel openings each defining a internal ridge or ledge which supports and secures in the forefoot and heel openings rigid plastic forefoot and heel plates, each bearing tungsten carbide spikes protruding from the bottom surfaces thereof. The inset forefoot and heel plates are affixed to the outsole such that the outsole, and forefoot and heel plates are maintained as a unitary member. The tungsten carbide spikes are overlaid with felt or other suitable gripping pads or material with the tips of the spikes protruding through the felt or gripping pad, but do not extend below the peripheral lugs or cleats.

DETAILED DESCRIPTION OF THE PREFERRED EMBODIMENT

Figure 1:
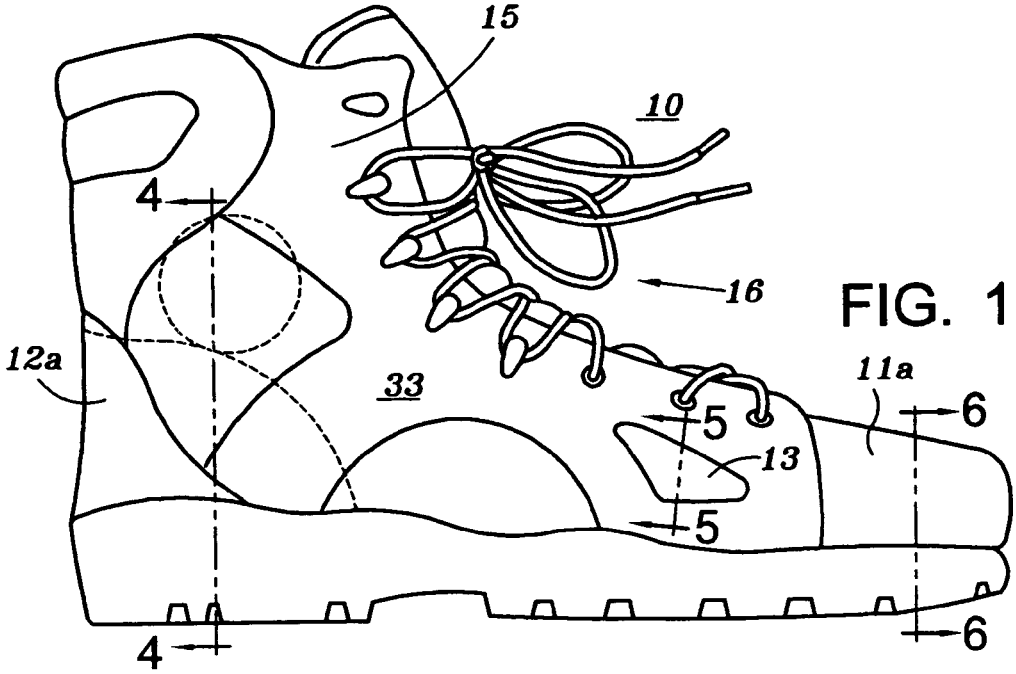
FIG. 1. is a side view of the Wading Boot
Figure 2:
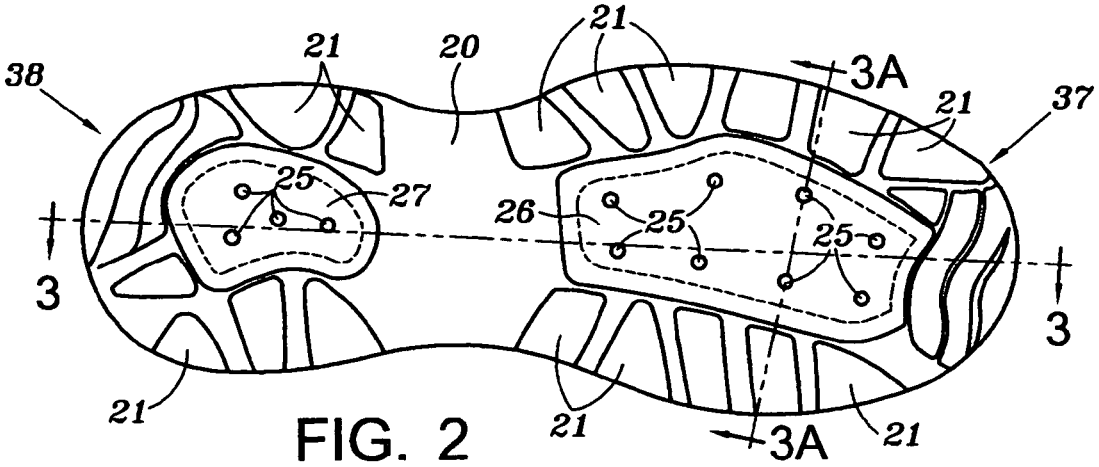
FIG. 2. is a bottom view of the Wading Boot in FIG. 1.
Figure 3:
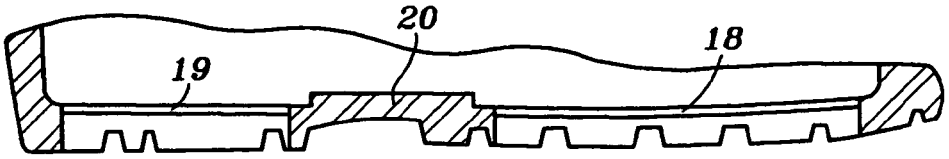
FIG. 3. is a cross sectional view taken along lines 3-3 of FIG. 2 illustrating the outsole openings.
Figure 5:
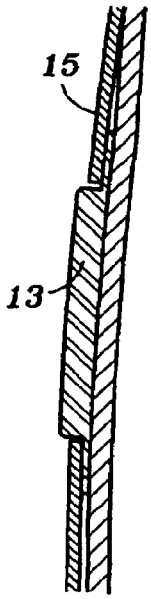
FIG. 5. is a cross sectional view of the boot inset taken along lines 5-5.
Figure 6:
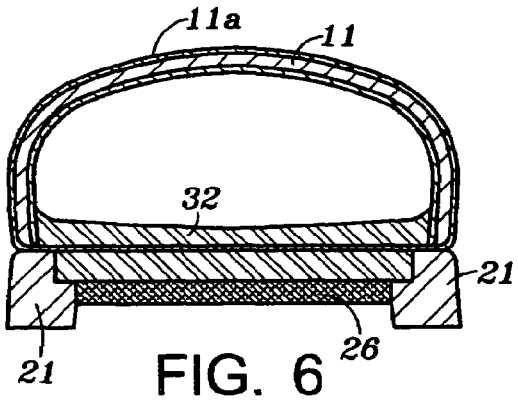
FIG. 6. is a cross section view a long lines 6-6 in FIG. 1.
Figure 4:
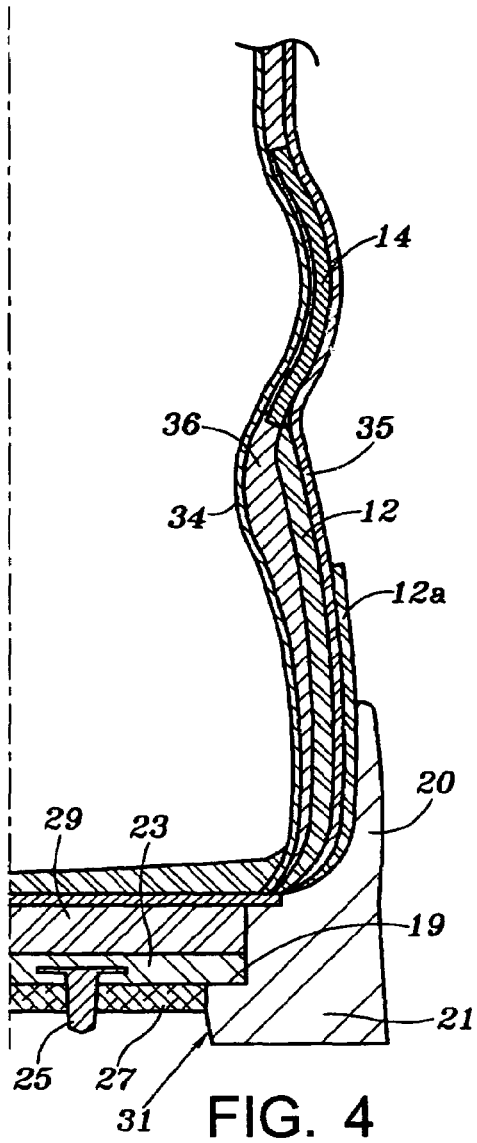
FIG. 4. is a cross sectional view taken along lines 4-4 of FIG. 1, illustrating a symmetrical half of the boot heel area.
Figure 3A:
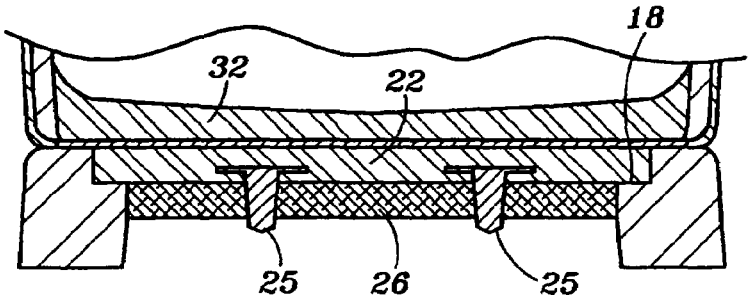
FIG. 3A. is a cross sectional view taken along lines 3A-3A of FIG. 2.

Referring now generally to the drawings, FIGS. 1 through 7, and in particular FIGS. 1,4 and 6, Wading Boot 10 having hard toe 11 and hard heel 12, high polymer skid pad 13 and ankle cup 14 which can best be seen in FIG. 4. is depicted. Wading Boot 10 has general eyelets and lacing arrangement 16 which permits ready removal and fastening of the wading boot 10 on the wearer. Outsole 20 mounts central forefoot spike plate 22 in forefoot openings 31, and central heel spike plate 23 in heel opening 3D. Each spike plate 22 and spike plate 23 retains a number of spaced-apart spikes 25. A felt forefoot 26 seats over spikes 25 in spike plate 22. Felt heel 27 seats over spikes 25 in spike plate 23. For extra comfort of the user, heel cushion 29 is positioned atop spike plate 23. Intermittent tread such as cleats or lugs 21 are formed along the periphery of outsole 20. As seen in FIG. 2 and FIG. 3A, fully assembled outsoles 20 secures spike plate 22 with metal spikes 25 extending just below felt forefoot 26 and above the intermittent tread such as cleats or lugs 21 of outsole 20. Likewise, outsole 20 secures spike plate 23 with metal spikes 25 extending just below felt heel 27 and above the cleats or lugs 21 of outsole 20.

In the preferred construction (see FIGS. 3, 3A, 4 and 7) outsole 20 has a central forefoot opening 30 which defines ledge or shelf 18 and central heel opening 31 which defines ledge or shelf 19 to which spike plate 22 is secured in forefoot opening 30 and spike plate 23 is secured in the heel opening 31, respectively. The felt forefoot 26 and felt heel 27 are positioned over spike plate 22 and spike plate 23, respectively, with spikes 25 extending through the felt forefoot 26 and felt heel 27, respectively, however, spikes 25 do not extend below lugs 21. Heel cushion 29 is affixed atop heel spike plate 23. Uppers, generally 33, are secured to outsole 20 by suitable means. Uppers 33 includes interior mesh cover 34 over a foam layer 36 which encloses a hard ankle cup 14 and exterior mesh cover 35 (see FIG. 4). Uppers 33 have hard heel 12 and heel cover 12*a* and hard toe 11 and toe cover 11*a*. Heel cover 12*a* and toe cover 11*a* may be of suitable scuff resistant material. Insole 32 extends throughout the interior sole of uppers 33 to provide cushion for the wearer's foot.

Referring particularly to FIGS. 4,5 and 6, the construction of uppers 33 may be done in various manners but the preferred features of the uppers are hard toe 11, hard heel 12, and the hard polymer skid pad 13 for protection of the wearer's metatarsus little and big toe (joints) and ankle cup 14 which protects the ankle bone. This construction provides protection from various hazards and comfort to the user.

Figure 7:
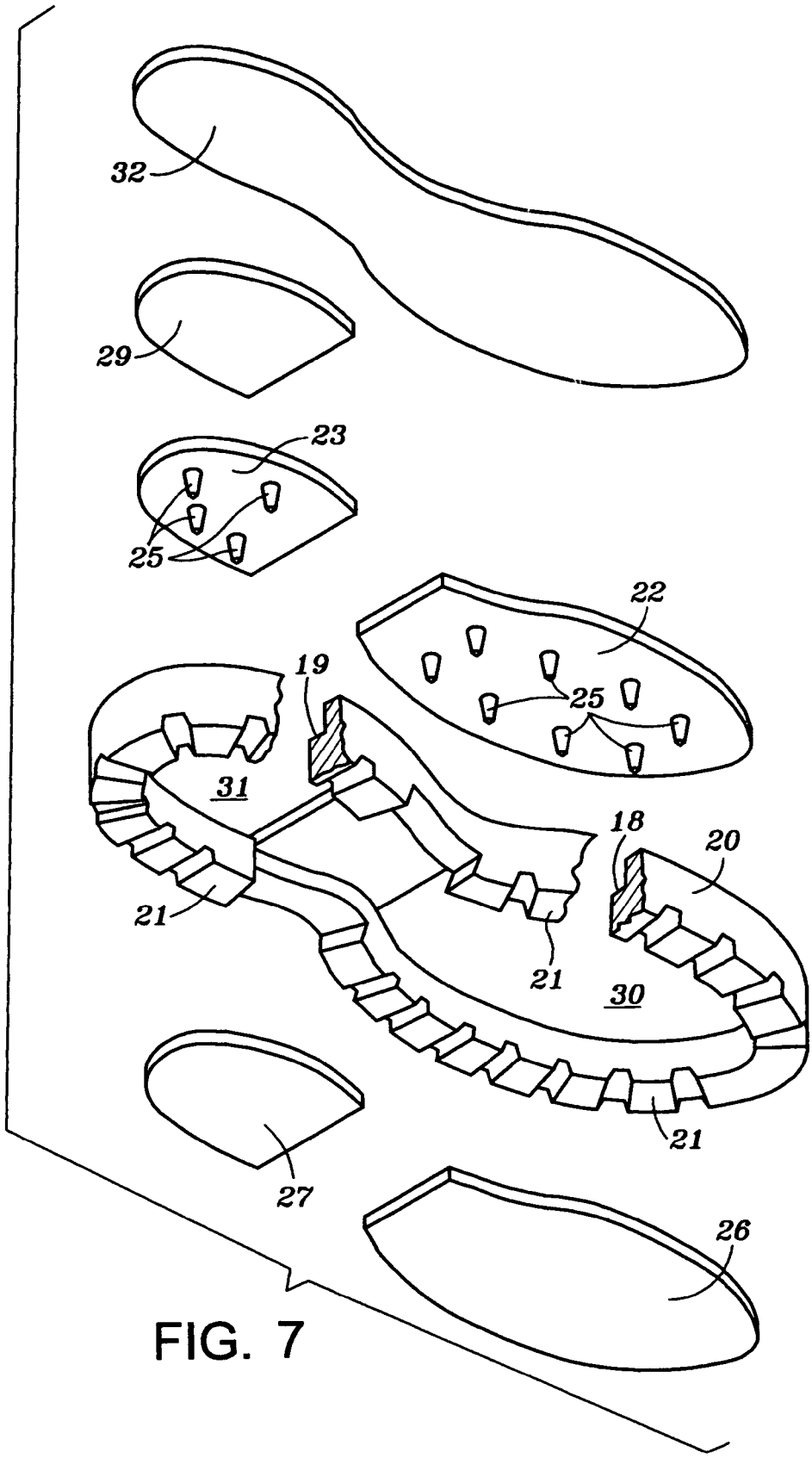
FIG. 7. is an exploded view of the outsole construction of the boot.

Construction of the outsole with spike plate 22, spike plate 23 and felt forefoot 26 and felt heel 27 may be provided in any suitable manner so long as intermittent tread shown as cleats or lugs 21 extends below spikes 25 and spikes 25 extends below felt forefoot 26 and felt heel 27 but not below cleats 21. Referring to FIGS. 2 and 7, the cleats may be as illustrated or take other forms. The fluted toe area 37 and fluted heel area 38 aid in the wearer maintaining stability while wading or walking in stream beds, rivers, and lakes.

Alternately, spikes 25 and felt forefoot 26 and felt heel 27 are coordinated to provide a felt sole with steel or tungsten carbide spikes that protrudes through the felt sole which gives maximum traction on river, stream and lake beds. The felt provides better traction on slippery rocks in the river, stream or lake beds. The combination of felt forefoot 26 and felt heel 27 with tungsten carbide spikes 25 is preferred. Although any suitable metal or steel may be used for the spikes 25, tungsten carbide provides long wear.

Alternatively, the uppers 33 and outsoles 20 may be constructed such that spikes 25 embedded in spike plate 22 and spike plate 23, with felt forefoot 26 and felt heel 27, respectively, may be replaced individually or as a unit as long as lugs or cleats 21 on outsole 20 have not worn too much such that spikes 25 protrude below cleats 21 on outsole 20 when replaced or resoled.

It will be understood that other construction of the boot outsole may be suggested by the preferred embodiment described herein, however, the most effective construction of the Wading Boot requires a unitary outsole with wear resistant spikes protruding through a felt pad surrounded by intermittent tread, lugs or cleats that extend below the spike tips. Although separate forefoot opening 30 and heel opening 31 provide a sturdy outsole these openings could be made a single opening with forefoot spike plate 22 and heel spike plate 23 as a unit.

What is claimed is:

1. A field and stream boot comprising:

(a) a unitary outsole including having;

(i) an outer area of the outsole forming peripheral intermittent tread there around;

(ii) an interior heel area of an outsole defining an open heel area; a heel member with heel gripping spikes overlaid and affixed by a uniform gripping pad with the heel gripping spikes extending through and below the uniform heel gripping pad but above the peripheral intermittent tread; and (iii) an interior forefoot area of an outsole defining an open forefoot area; a forefoot member with forefoot gripping spikes overlaid and affixed by a uniform gripping pad with the forefoot gripping spikes extending through and below the uniform forefoot gripping pad but above the peripheral intermittent tread;

(b) an upper boot construction affixed to the outsole; and (c) a fastener attached to the upper boot construction for retaining the boot on the foot of a user.

2. The boot of claim 1 wherein the intermittent tread is a series of lugs.

3. The boot of claim 1 wherein the heel gripping spikes and the forefoot gripping spikes are metal.

4. The boot of claim 3 wherein the metal is tungsten carbide.

5. The boot of claim 1 wherein the heel gripping pad and the forefoot gripping pad are felt material.

6. The boot of claim 4 wherein the heel gripping pad and the forefoot gripping pad are felt material.

7. The boot of claim 1 wherein the upper boot construction includes a hard toe, a hard heel, a pair of rigid ankle cups, and a pair of rigid inset panels for protection of the metatarsus.

8. A wading boot outsole construction comprising:

(a) a polymeric member defining an open heel area with a shelf there around and an open forefoot area with a shelf there around, and having downward extending peripheral lugs;

(b) a heel member, having multiple spikes, seated and affixed to the shelf in the open heel area;

(c) a forefoot member, having multiple spikes, seated and affixed to the shelf in the open forefoot area;

(d) uniform felt material overlaid and affixed to the heel member; and the spikes protrude through the uniform felt member but do not extend as far as the peripheral lugs extremity; and (e) uniform felt material overlaid and affixed to the forefoot member; and the spikes protrude through the uniform felt member but do not extend as far as the peripheral lugs extremity.

9. The outsole construction of claim 8 wherein the spikes are metal.

10. The outsole construction of claim 9 wherein the metal is tungsten carbide.

11. In a wading boot, the improvement comprising:

(a) an outsole having an interior heel opening and an interior forefoot opening, the outsole including a ledge around the interior heel opening and a ledge around the interior forefoot opening, and having peripheral intermittent tread;

(b) a heel member with multiple, integral heel gripping spikes seated in the central heel opening and secured to the outsole along the ledge as a unitary member thereof;

(c) a forefoot member with multiple, integral forefoot gripping spikes seated in the forefoot opening and secured to the outsole along the inboard ledge as a unitary member thereof;

(d) uniform a heel gripping pad overlaying the heel member and adhering thereto with the multiple integral heel gripping spikes protruding through the heel gripping pad and extending less distal from the outsole than the peripheral intermittent tread; and (e) uniform a forefoot gripping pad overlaying the forefoot member and adhering thereto with the multiple integral forefoot gripping spikes protruding through the forefoot gripping pad and extending less distal from the outsole than the peripheral intermittent tread.

12. The boot sole of claim 11 wherein the peripheral intermittent tread is a series of lugs.

13. The boot sole of claim 12 wherein the spikes are metal.

14. The boot sole of claim 13 wherein the metal is tungsten carbide.

15. The boot sole of claim 11 wherein the heel gripping pad and the forefoot gripping pad are fabric.

16. The boot sole of claim 15 wherein the fabric is felt.

* * * * *